United States Patent [19]

Davis et al.

[11] Patent Number: 4,508,226

[45] Date of Patent: Apr. 2, 1985

[54] SEALED CARTON WITH TAMPER INDICATING FEATURES

[75] Inventors: Robert E. Davis, Nutley; Patrick S. Maio, Ringwood, both of N.J.; Lawrence J. Growney, Pearl River, N.Y.

[73] Assignee: Federal Paper Board Company, Incorporated, Montvale, N.J.

[21] Appl. No.: 514,947

[22] Filed: Jul. 18, 1983

Related U.S. Application Data

[63] Continuation-in-part of Ser. No. 443,754, Nov. 22, 1982.

[51] Int. Cl.[3] ..... B65D 5/54

[52] U.S. Cl. ..... 206/620; 206/622; 206/628; 206/807; 229/37 R

[58] Field of Search ..... 229/37 R, 38, 39 R, 229/80; 206/807, 247, 620, 622, 625, 626, 628, 634

[56] References Cited

U.S. PATENT DOCUMENTS

| | | | |
|---|---|---|---|
| 1,242,534 | 10/1917 | Eaton | 229/38 X |
| 2,007,520 | 7/1935 | Daller | 206/622 |
| 2,260,137 | 10/1941 | Donnelly | 206/622 |
| 2,471,883 | 5/1949 | Miessler | 229/39 R |
| 2,609,138 | 9/1952 | Weiss | 229/37 R |
| 2,670,128 | 2/1954 | Stowitts | 229/37 R |
| 2,996,235 | 8/1961 | Turpin | 229/37 R |
| 3,638,853 | 2/1972 | Perry | 229/38 X |
| 3,833,165 | 9/1974 | Hoiles | 229/37 R |
| 4,397,415 | 8/1983 | Lisiecki | 229/37 R X |

FOREIGN PATENT DOCUMENTS

| | | | |
|---|---|---|---|
| 700533 | 12/1964 | Canada | 229/37 R |

*Primary Examiner*—William Price
*Assistant Examiner*—Gary E. Elkins
*Attorney, Agent, or Firm*—Charles E. Brown; Charles A. Brown

[57] ABSTRACT

This relates to a sealed carton formed of paperboard which is provided with tamper indicating features. First of all, the ends of the carton are formed of a combination of partial and full closure flaps and the full closure flaps are provided with weakened areas so that if the closure flaps are attempted to be separated, there will be a rupture of either one or both of the full closure flaps so as to indicate attempted tampering. On the other hand, if an attempt is made to open the carton along the joint between the body panel and the connecting panel, the connecting panel carries at opposite ends thereof closure flaps which are incorporated in the ends of the carton and there is a weakening line arrangement such that rupture of the closure flaps carried by the connecting panel from the connecting panel will occur to indicate an attempt to tamper.

19 Claims, 12 Drawing Figures

SEALED CARTON WITH TAMPER INDICATING FEATURES

This application is a continuation-in-part of our copending application Ser. No. 443,754 filed Nov. 22, 1982.

This invention particularly relates to a sealed carton wherein the body forming panels include a connecting panel which is adhesively secured to an adjacent endmost body panel in overlapping relation and wherein the joint between the connecting panel and the adjacent body panel has an open edge such that the connection could be severed by inserting a knife or other sharp blade. In accordance with this invention, the connecting panel is provided at each end thereof with an end flap which is bonded between other end flaps of the carton at both ends of the carton. Each end flap is attached to its connecting panel along a fold line which overlaps a fold line between the body panel to which the connecting panel is secured and the respective closure flap carried by that body panel. One or both of the fold lines is weakened whereby when the adhesive bond is ruptured, any attempt to open the carton between the connecting panel and the body panel to which it is secured will result in the rupture of the respective closure flap from the connecting panel.

Another feature of the sealed carton is the provision of full closure flaps which are provided with weakened edges wherein any attempt to separate the closure flaps to open the end of the carton will result in the rupture of the closure flaps to give evidence of tamper.

A further feature of the invention is the formation of at least one end of the sealed carton with perforated hinge lines between respective ones of the closure flaps whereby the closed end at one or both ends of the carton may be opened by rupturing three of the four closure flaps plus the closure flap carried by the connecting panel.

With the above and other objects in view that will hereinafter appear, the nature of the invention will be more clearly understood by reference to the following detailed description, the appended claims, and the several views illustrated in the accompanying drawings.

Figure 1:
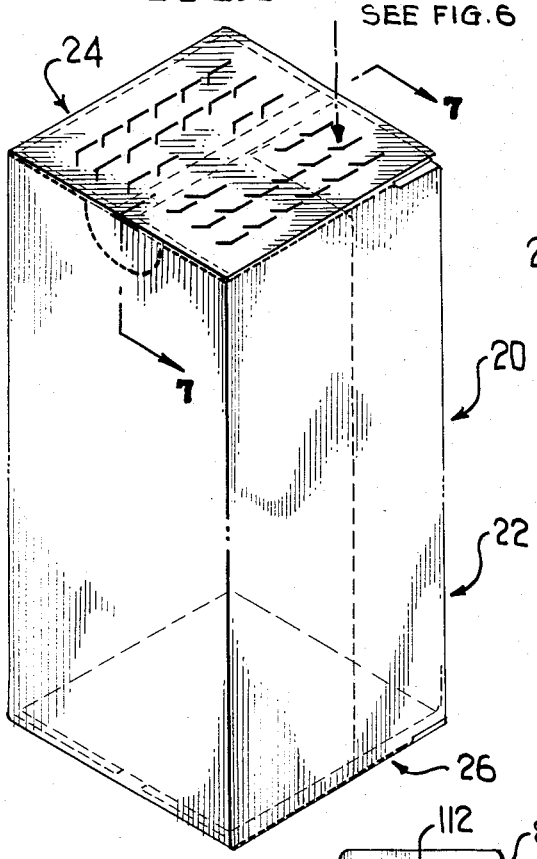
FIG. 1 is a top perspective view of a sealed carton formed in accordance with this invention.
Figure 2:
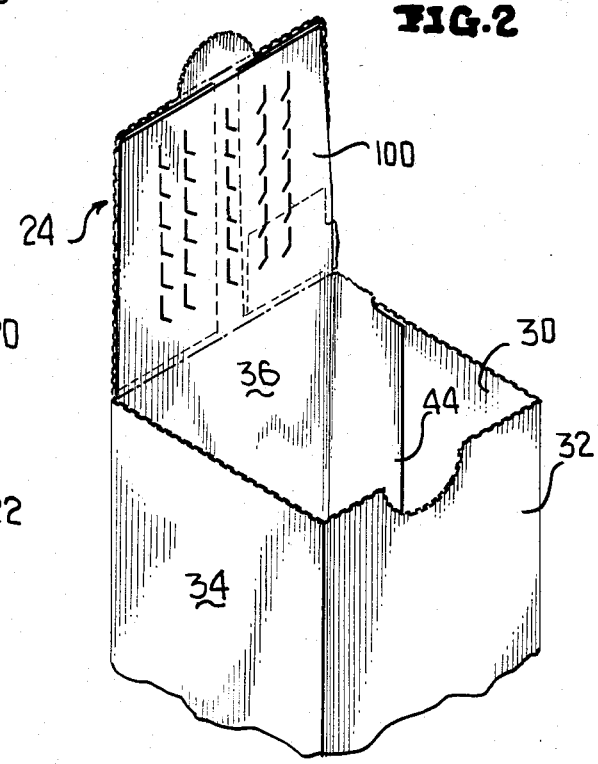
FIG. 2 is a fragmentary top perspective view similar to FIG. 1 but with the carton in its open state.

Referring now to the drawings in detail, it will be seen that there is illustrated in FIG. 1 a sealed carton formed in accordance with this invention, the carton being generally identified by the numeral 20. The carton 20 includes a generally rectangular cross sectional body 22 which is closed at its opposite ends to define an upper end 24 and a lower end 26. The carton 20 is particularly configurated so that the upper end 24 may be moved to an open position as is shown in FIG. 2. The carton 20 is further constructed so as to give evidence of any one attempting to enter into the carton without opening the same in the manner shown in FIG. 2.

Figure 3:
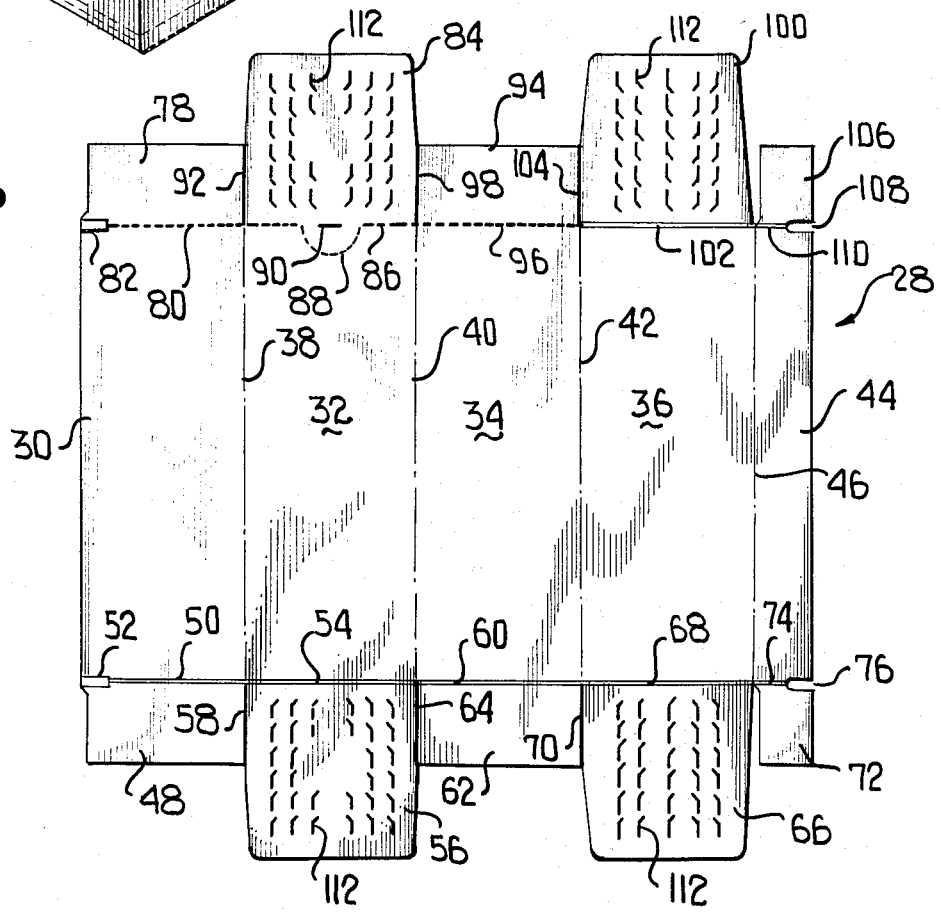
FIG. 3 is a plan view of a blank from which the carton of FIG. 1 is formed.

Referring now to FIG. 3, it will be seen that there is illustrated a blank, generally identified by the numeral 28, from which the carton of FIG. 1 is formed. The blank 28 is formed of suitable paperboard and is generally rectangular in outline. The blank has a central portion which is divided by fold lines to define body panels 30, 32, 34 and 36 of which the body panels 30 and 36 are endmost body panels. The longitudinal fold line 38 separates the body panels 30, 32; a longitudinal fold line 49 separates the body panels 32, 34; and a longitudinal fold line 42 separates the body panels 34, 36. There is also a connecting panel 44 which is connected to the body panel 36 along a fold line 46.

The body panel 30 carries at one end thereof a closure flap 48 which is connected to the body panel 30 along a transverse fold line 50 of which an end portion only is in the form of a bar score 52. The length of the bar score 52 is equal to substantially one half the width of the connecting panel 44.

The closure flap 48 is of approximately half the width of the body panels 32, 36. The body panel 32 carries along a transverse fold line 54, which is a continuation of the fold line 50, a full closure panel 56. The closure panel 56 is separated from the adjacent closure panel 48 along a cut line 58.

The body panel 34 carries along a transverse fold line 60, which is a continuation of the fold line 50, 54, another partial closure flap 62. The closure flap 62 is separated from the closure flap 56 along a cut line 64 which is a continuation of the fold line 40.

Next there is a full closure flap 66 which is connected to the body panel 36 along a transverse fold line 68 which is a continuation of the fold line 50, 54 and 60. The closure flap 60 is separated from the closure flap 62 by a cut line 70.

The connecting panel 44 also carries a partial closure flap 72 which is in part connected to the connecting panel 44 along a fold line 74. The fold line 74 is a partial fold line and terminates in a slot 76 which opens through the free edge of the connecting panel 44.

The opposite end of the blank 78 is similar to, yet somewhat different from the aforedescribed end. First of all, the body panel 30 carries a partial closure panel 78 which is connected thereto primarily along a perforated fold line 80. The perforated line 80 terminates at its left end in a bar score 82 which is similar to the bar score 52.

Next, the body panel 32 carries a complete closure flap 84 which is connected to the body panel 32 along a perforated fold line 86 which has a generally semi-circular central portion 88 which projects into the body panel 32. In the center of the semi-circular portion 88 of the perforated fold line 86 is a perforated portion 90 which forms a continuation of the fold line defined by the primary part of the perforated fold line 86. The closure panel 84 is separated from the closure panel 78 by a cut line 92.

A partial closure flap 94 is connected to the body panel 34 along a perforated fold line 96. The closure flap 94 is separated from the closure flap 84 along a longitudinal cut line 98.

The body panel 36 carries a full closure flap 100 which corresponds to the closure flap 66 and is connected to the body panel 36 along a fold line 102. The closure flaps 94 and 100 are separated by a cut line 104.

Finally, the blank defines a partial closure flap 106 which is separated from the connecting panel 44 by a slot 108 which opens through the free edge of the blank. The closure flap 106 is hingedly connected to the connecting panel 44 along a partial fold line 110.

Figure 4:
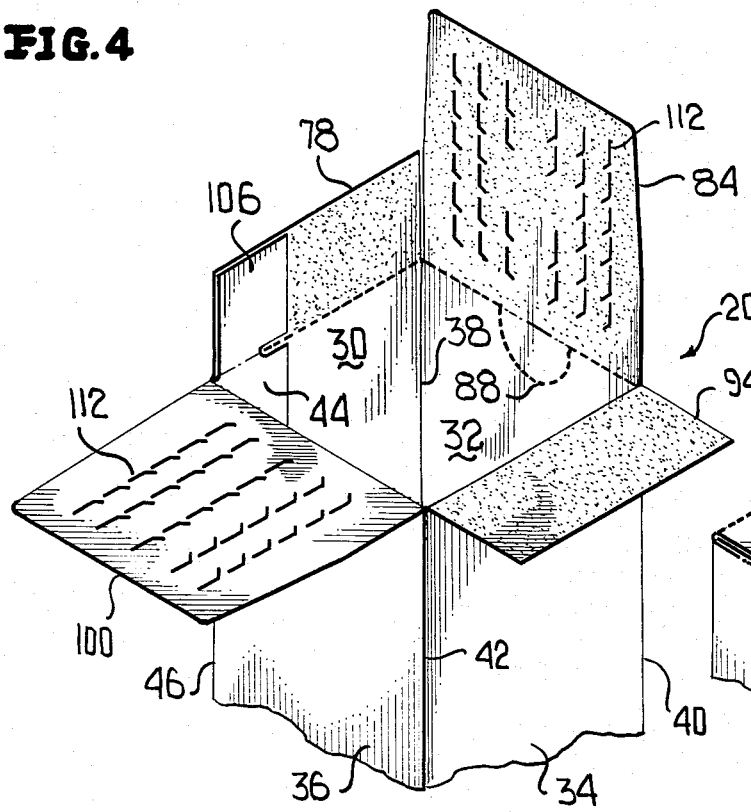
FIG. 4 is a top perspective view showing the connecting panel bonded to the adjacent body panel and the connecting flap carried by the connecting planel bonded to the closure flap carried by the adjacent body panel.

At this time it is pointed out that each of the full closure flaps 56, 66, 84 and 100 is provided with weakened areas which are defined by series of angular cut lines 112. The cut lines 112 are arranged in suitable patterns with it being feasible that the patterns of the cut lines 112 in the closure flaps 56, 84 being different from those in the closure flaps 66, 100. Referring now to FIG. 4 in particular, it will be seen that in the formation of the carton 20, the body panels are folded about their respective fold lines to a generally rectangular configuration with the connecting panel 44 overlapping the body panel 30 and the connecting flap 106 overlapping the connecting flap 78. Although not shown, at the opposite end of the body panel 30, the closure flap 72 will overlap the closure flap 48. The connecting panel 44 and the closure flaps 72 and 106 will be adhesively bonded to their respective components.

Figure 5:
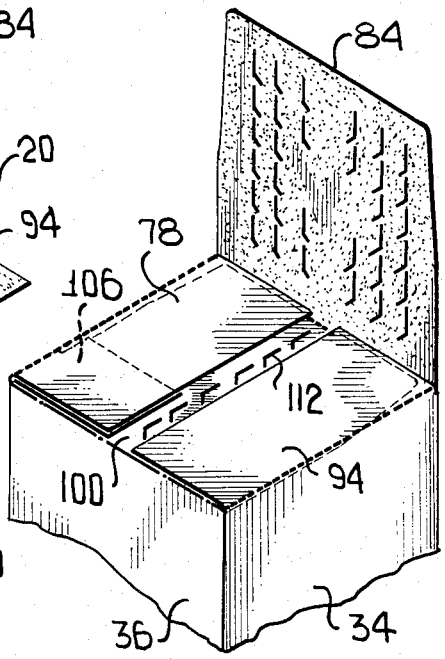
FIG. 5 is a fragmentary perspective view similar to FIG. 4 and shows all but the outermost closure flap in their end forming positions.
Figure 7:
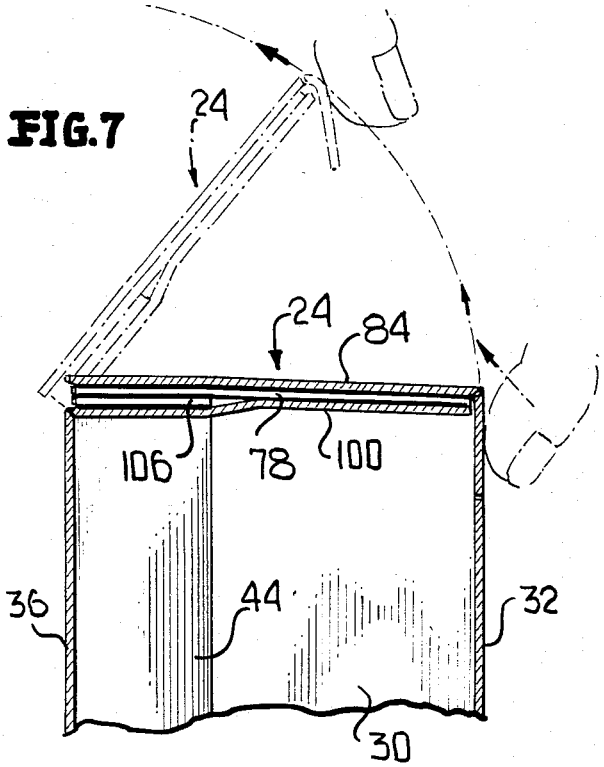
FIG. 7 is a fragmentary vertical sectional view taken generally along the line 7—7 of FIG. 1 and shows the details of the closed end of the carton, the closed end being illustrated as being moved to an open position in phantom lines.
Figure 6:
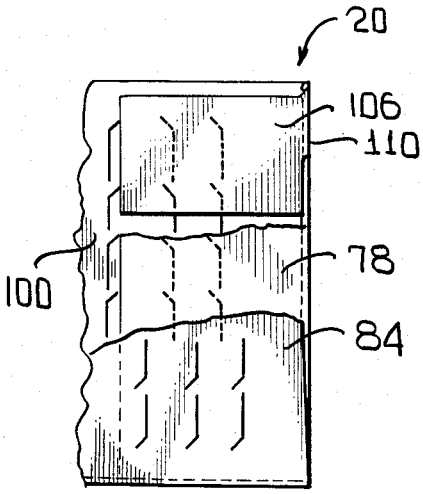
FIG. 6 is a top plan view of a portion only of the top end with portions of the closure flap broken away to show their relationship between the various closure flaps.

As will be readily apparent from FIGS. 5 and 6, the closure flap 100 will be first folded inwardly, after which the closure flaps 78, 106 will be folded inwardly from one side of the carton and the closure flap 94 folded inwardly from the opposite side of the carton. Suitable adhesive on the closure flaps 94, 78, 106 will bond the closure flaps to the underlying closure flap 100. Finally, the closure flap 84, which is provided with adhesive on the underside thereof will be folded into overlying relation to the closure flaps 78, 94 to complete the end 24 of the carton. The closure flaps 48, 56, 62, 66 and 72 will be folded together and adhesively bonded together in the same manner to form the end 26.

When it is desired to open the carton 20, that portion of the upper part of the body panel 32 defined by the semi-circular perforation arrangement 88 is pressed inwardly, rupturing the body panel 32 along the perforations 88. After this occurs, the finger pressing in on the body panel 32 engages beneath the end 24 and lifts upwardly tearing the top or end 24 from the body 22 along the perforated fold lines 80, 86, and 96 while causing rupture of the bar score 82 and that portion of the fold line 110 which connects the closure flap 106 to the connecting panel 44.

The bottom end 26 is not intended to be open.

It is to be understood that all cartons formed in the general manner such as the carton 20 are subject to possible tempering. For example, the connection between the connecting panel 44 and the body panel 30 has an edge open to the exterior. A thin blade may be inserted between the connecting panel 44 and the body panel 30 to disrupt the adhesive bond. However, any attempt to separate the two panels sufficiently to gain access to the interior of the carton 20 will result in the rupturing of the connecting panel 44 from either the closure panel 72 or the closure panel 106 or both due to the weakening provided for by the bar score 82 and the slot 108. Thus there will be ready evidence of tampering. In a like manner, by providing the full closure panels 100, 112 at the top end of the carton and the full closure panels 56, 66 at the bottom end of the carton, any attempt to separate the closure flaps will result in the rupture of either the closure flap 84 or the closure flap 100 which will give evidence of tampering.

Figure 8:
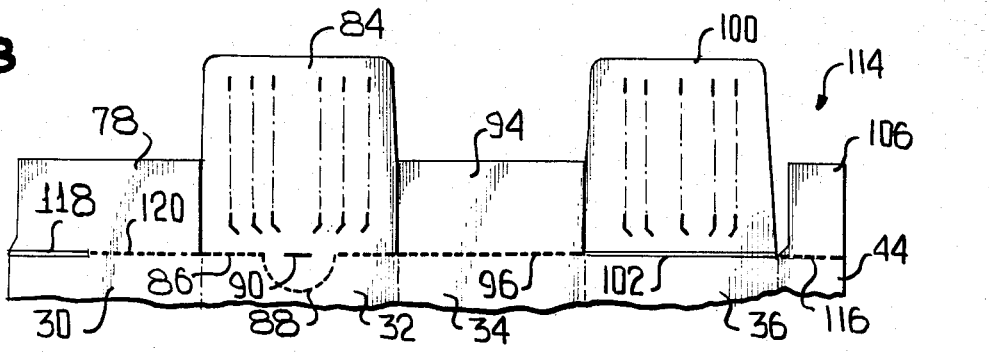
FIG. 8 is a fragmentary plan view of a blank with a modified form of weakening line arrangement for the closure flap carried by the connecting panel.

Referring now to FIG. 8 in particular, it will be seen that there is illustrated an end portion of a modified form of blank, which blank is generally identified by the numeral 114. The blank 114 will be identical with the blank 28 except that in lieu of the closure flap 106 being connected to the connecting panel 44 along a combination fold line and slot, it is connected thereto along a perforated line 116. Also, in lieu of the closure flap 78 being connected to the body panel 30 along a combination of a bar score having a width equal to approximately one half of the width of the closure flap 106 and the remainder a perforated line, the closure flap 78 is connected to the body panel 30 along a bar score 118 of a length equal to the full width of the closure flap and thereafter a perforated fold line 120.

A carton formed from the blank 114 will function in the same manner as the described carton 20.

It is to be understood that the other end of the blank 114 may be constructed either exactly like the blank 28 or the closure flap 48 may be connected to the body panel 30 in the manner described with respect to the closure flap 78 and the closure flap 72 may be connected to the connecting panel 44 in the manner illustrated with respect to the closure flap 106.

Figure 9:
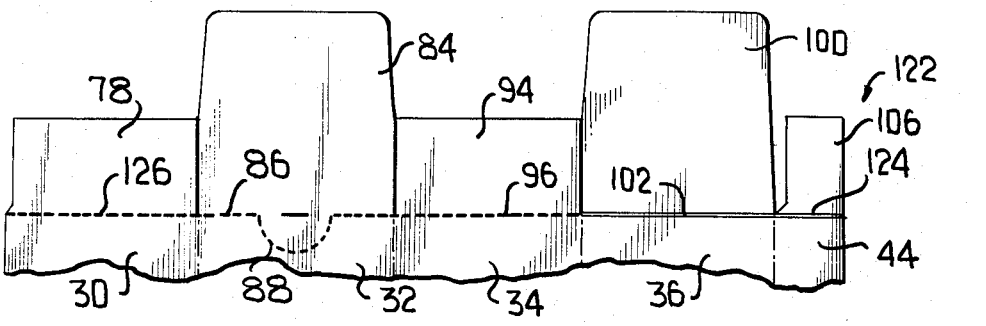
FIGS. 9, 10, 11 and 12 are further fragmentary plan views of modified forms of blanks similar to FIG. 8.

Referring now to FIG. 9, it will be seen that there is illustrated a modified form of blank generally identified by the numeral 122. In this blank construction the closure flap 106 is connected to the connecting panel 44 along a full width fold line 124. On the other hand, the closure flap 78 is connected to the body panel 30 along a full length perforated fold line 126. The modified construction of the blank 122 may be also incorporated at the opposite end thereof.

Figure 10:
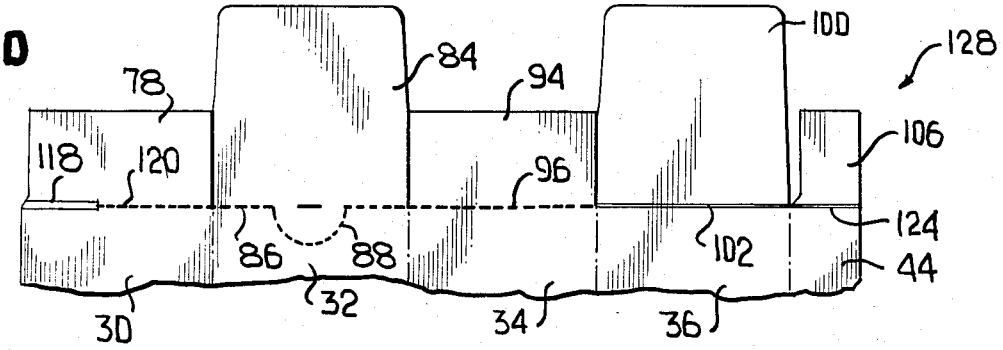

Referring now to FIG. 10, it will be seen that there is illustrated yet another modified blank 128 which incorporates part of the modifications of FIG. 8 and part of the modifications of FIG. 9. The closure flap 106 will be connected to the connecting panel 44 along a full width fold line, such as the previously described fold line 124. On the other hand, the closure flap 78 will be connected to the body panel 30 along a wide bar score 118 and a perforated fold line continuation 120 as illustrated in FIG. 8. It is to be understood that the opposite end of the blank 128 may be similarly formed.

Figure 11:
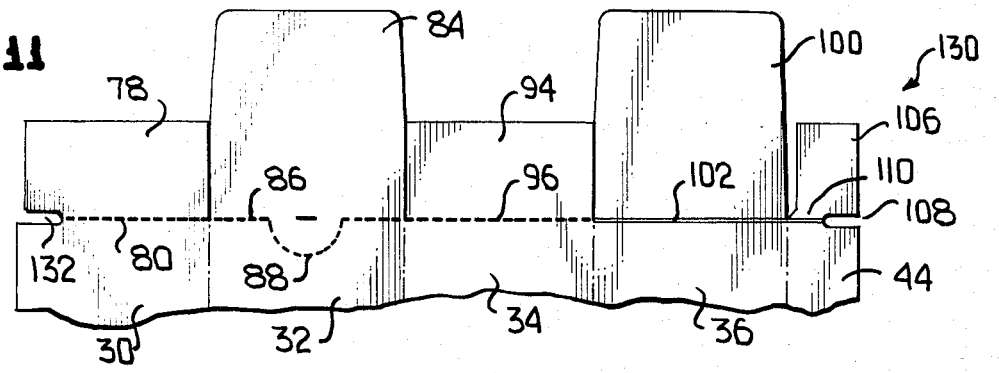

Referring now to the blank of FIG. 11, which blank is identified by the numeral 130, it will be seen that the closure flap 106 is connected to the connecting panel 44 by the same combination of fold line 110 and slot 108 as utilized in the blank 28. On the other hand, the bar score 82 between the closure flap 78 and the body panel 30 is replaced by a slot 132. Similar modifications may be incorporated in the opposite end of the blank 130.

Figure 12:
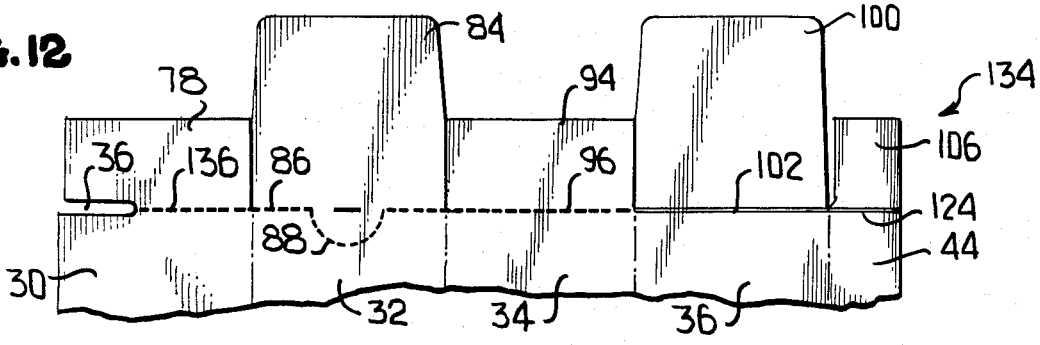

Referring finally to the blank of FIG. 12, it will be seen that the blank is generally identified by the numeral 134. The blank 134 is modified to the extent that the closure flap 106 is connected to the connecting panel 44 along a transverse fold line 124 as shown with respect to the blank 128 in FIG. 10. On the other hand, in lieu of the half width slot 132 of FIG. 11, there is a slot 136 opening out through the free edge of the blank 134 and being disposed between the closure flap 78 and the body panel 30. The slot 36 will be of a width corresponding to the width of the closure flap 106. The connecting flap 78 will be connected to the body panel 30 along a partial length perforated fold line 136. Once again, it is to be understood that the same modification may be made in the opposite end of the blank 134.

Although only preferred embodiments of the sealed carton in general and the tamper indicating means in particular have been specifically illustrated and described herein, it is to be understood that minor variations may be made in the carton and blank construction without departing from the spirit and scope of the invention as defined by the appended claims.

What is claimed as new is:

1. A carton having a body defined by body panels and two opposite ends defined by closure flaps, said closure flaps being bonded together to resist separation, at least certain of said closure flaps of one of said ends being connected to respective ones of said body panels by rupturable connections for the at least partial tearing of said one end from said carton body as a unit, and said body including a connecting panel carried by one endmost one of said body panels and overlapping and bonded to another endmost one of said body panels, and a terminal flap carried by said connecting panel at an end thereof and bonded to an innermost one of said closure flaps at said one end, said terminal flap being connected to said connecting panel along a fold line which is aligned with and overlaps a portion of a fold line extending between said another endmost body panel and a respective one of said closure flaps, said overlapped fold line portions being jointly weakened wherein between said two overlapped fold line portions there is a total of approximately only one fold line portion or less which is unweakened whereby tampering with said carton along the connection between said connecting panel and said another endmost body panel to gain entry will result in the separation of said terminal flap from said connecting panel.

2. A carton according to claim 1 wherein an outermost one of said closure flaps at at least one end of said carton extends entirely across said carton one end is provided with weakened areas wherein when an attempt is made to separate the bond between said outermost closure flap and an underlying closure flap rupture of said outermost closure flap along at least one of said weakened areas will occur.

3. A carton according to claim 1 wherein said closure flaps at one end of said carton include two full closure flaps and two partial closure flaps arranged in alternating relation about said body, said partial closure flaps being sandwiched between said full closure flaps, and an innermost of said full closure flaps and said two partial closure flaps are each connected to a respective body panel along a weakened line to facilitate the removal of said one end as a unit.

4. A carton according to claim 1 wherein said closure flaps at one end of said carton include two full closure flaps and two partial closure flaps arranged in alternating relation about said body, said partial closure flaps being sandwiched between said full closure flaps, and an innermost of said full closure flaps and said two partial closure flaps are each connected to a respective body panel along a weakened line to facilitate the removal of said one end as a unit with said removed end remaining hingedly connected to said carton body along a fold line connecting the outermost of said closure flaps to said carton body.

5. A carton according to claim 3 wherein an outermost one of said closure flaps at at least one end of said carton extends entirely across said carton one end and is provided with weakened areas wherein when an attempt is made to separate the bond between said outermost closure flap and an underlying closure flap rupture of said outermost closure flap along at least one of said weakened areas will occur.

6. A carton according to claim 1 wherein each of said full closure flaps is provided with weakened areas wherein when an attempt is made to separate said closure flaps at least one of said weakened areas will rupture thereby giving evidence of an attempt to tamper.

7. A carton according to claim 1 wherein the weakening of said overlapped fold line portions is entirely in one of said overlapped fold line portions.

8. A carton according to claim 1 wherein the weakening of said overlapped fold line portions is partially in each of said overlapped fold line portions.

9. A carton according to claim 1 wherein the weakening of said overlapped fold line portions is partially in each of said overlapped fold line portions and in non-overlapping relation.

10. A carton according to claim 1 wherein the weakening of said overlapped fold line portions is entirely across one of said overlapped fold line portions.

11. A carton according to claim 7 wherein said weakening of said overlapped fold line portions is entirely along said fold line extending between said another endmost body panel and its respective closure flap.

12. A carton according to claim 7 wherein said weakening of said overlapped fold line portions is entirely along said fold line extending between said another endmost body panel and its respective closure flap and is in the form of a perforation.

13. A carton according to claim 7 wherein said weakening of said overlapped fold line portions is entirely along said fold line extending between said another endmost body panel and its respective closure flap and is in the form of a bar score.

14. A carton according to claim 7 wherein said weakening of said overlapped fold line portions is entirely along said fold line extending between said another endmost body panel and its respective closure flap and is in the form of a slot.

15. A carton according to claim 1 wherein the weakening of said overlapped fold line portions is entirely across both of said overlapped fold line portions.

16. A carton according to claim 8 wherein each of said weakening is in the form of a slot.

17. A carton according to claim 8 wherein one of said weakening is in the form of a notch and the other of said weakening is in the form of a bar score.

18. A carton according to claim 1 wherein each of said weakening is to an edge of a respective one of said connecting panel and said another endmost body panel.

19. A carton having a body defined by body panels and two opposite ends defined by closure flaps, said closure flaps being bonded together to resist separation, at least certain of said closure flaps of one of said ends being connected to respective ones of said body panels by rupturable connections for the at least partial tearing of said one end from said carton body as a unit, and said body including a connecting panel carried by one endmost one of said body panels and overlapping and bonded to another endmost one of said body panels, an outermost one of said closure flaps at one end of said carton extending entirely across said carton one end and being provided with weakened areas wherein when an attempt is made to separate the bond between said outermost closure flap and an underlying closure flap rupture of said outermost closure flap along at least one of said weakened areas will occur.

* * * * *